US009127871B2

(12) United States Patent
Bortoletto et al.

(10) Patent No.: US 9,127,871 B2
(45) Date of Patent: Sep. 8, 2015

(54) ICE MAKING, TRANSFERRING, STORING AND DISPENSING SYSTEM FOR A REFRIGERATOR

(75) Inventors: Anderson Bortoletto, Waunakee, WI (US); Nihat Cur, Saint Joseph, MI (US); James C. L. Guarino, Kalamazoo, MI (US); Tony L. Koenigsknecht, Chicago, IL (US); Ronald L. Voglewede, Saint Joseph, MI (US); Matthew E. Young, Chicago, IL (US)

(73) Assignee: Whirlpool Corporation, Benton Harbor, MI (US)

( * ) Notice: Subject to any disclaimer, the term of this patent is extended or adjusted under 35 U.S.C. 154(b) by 401 days.

(21) Appl. No.: 13/165,973

(22) Filed: Jun. 22, 2011

(65) Prior Publication Data

US 2012/0324913 A1 Dec. 27, 2012

(51) Int. Cl.

| | |
|---|---|
| ***F25C 5/18*** | (2006.01) |
| ***F25C 1/00*** | (2006.01) |
| ***F25D 11/02*** | (2006.01) |
| ***F25D 25/00*** | (2006.01) |
| ***F25C 5/02*** | (2006.01) |

(52) U.S. Cl.
CPC .... *F25C 1/00* (2013.01); *F25C 5/18* (2013.01)

(58) Field of Classification Search
CPC ..... F25C 5/005; F25C 5/02; F25C 5/007; F25C 2400/10; F25C 5/18; F25C 1/04; F25C 1/24; F25C 1/147; F25D 11/025
USPC ..... 62/334, 377, 344, 66, 320
See application file for complete search history.

(56) References Cited

U.S. PATENT DOCUMENTS

| | | | | |
|---|---|---|---|---|
| 1,825,698 | A | | 10/1931 | King |
| 2,349,367 | A | | 5/1944 | Muffly |
| 3,380,261 | A | | 4/1968 | Hendrix et al. |
| 3,418,823 | A | | 12/1968 | Salimbeni Vivai |
| 3,433,030 | A | | 3/1969 | Jacobs |
| 3,526,100 | A | | 9/1970 | Briel |
| 3,537,132 | A | * | 11/1970 | Alvarez ..... 62/266 |
| 3,789,620 | A | * | 2/1974 | Benasutti et al. ..... 62/344 |
| 4,102,672 | A | | 7/1978 | Kida et al. |
| 4,184,339 | A | | 1/1980 | Wessa |
| 4,199,956 | A | | 4/1980 | Lunde |
| 4,207,750 | A | | 6/1980 | Simkens |
| 4,896,800 | A | | 1/1990 | Corey |
| 5,032,157 | A | | 7/1991 | Ruff |
| 5,187,948 | A | | 2/1993 | Frohbieter |
| 5,207,761 | A | | 5/1993 | Ruff |
| 5,211,462 | A | * | 5/1993 | Bien et al. ..... 312/404 |

(Continued)

FOREIGN PATENT DOCUMENTS

| | | |
|---|---|---|
| EP | 0227611 A1 | 7/1987 |
| EP | 0580950 A1 | 2/1994 |

(Continued)

*Primary Examiner* — Frantz Jules
*Assistant Examiner* — Joseph Trpisovsky

(57) ABSTRACT

An ice making, transferring and storing system includes an icemaker located in the fresh food compartment and an ice storage bin, located in one of the fresh food and freezer compartments, for receiving ice from the icemaker. A first ice transfer mechanism delivers ice from the icemaker to the ice storage bin. An ice dispenser is located in one of the fresh food and freezer doors. A second ice transfer mechanism selectively delivers ice from the ice storage bin to the ice dispenser.

10 Claims, 5 Drawing Sheets

(56) References Cited

U.S. PATENT DOCUMENTS

| | | | | |
|---|---|---|---|---|
| 5,212,957 | A | 5/1993 | Ruff | |
| 5,272,884 | A | 12/1993 | Cur et al. | |
| 5,297,394 | A | 3/1994 | Frohbieter et al. | |
| 5,369,901 | A * | 12/1994 | Revlett | 40/405 |
| 5,375,432 | A | 12/1994 | Cur | |
| 5,425,243 | A | 6/1995 | Sanuki et al. | |
| 5,987,900 | A | 11/1999 | Love | |
| 6,000,228 | A | 12/1999 | Johnson et al. | |
| 6,019,447 | A | 2/2000 | Jackovin | |
| 6,647,739 | B1 | 11/2003 | Kim et al. | |
| 6,688,130 | B1 | 2/2004 | Kim | |
| 6,688,131 | B1 | 2/2004 | Kim et al. | |
| 6,742,351 | B2 | 6/2004 | Kim et al. | |
| 6,907,744 | B2 | 6/2005 | Miller et al. | |
| 6,952,937 | B2 | 10/2005 | Choi et al. | |
| 7,062,936 | B2 | 6/2006 | Rand et al. | |
| 7,082,782 | B2 | 8/2006 | Schlosser et al. | |
| 7,726,756 | B2 | 6/2010 | Fu | |
| 8,161,766 | B2 * | 4/2012 | Shin et al. | 62/344 |
| 2004/0255606 | A1 | 12/2004 | Hornung | |
| 2006/0086127 | A1 * | 4/2006 | Anselmino et al. | 62/340 |
| 2006/0201189 | A1 * | 9/2006 | Adamski et al. | 62/334 |
| 2006/0218936 | A1 * | 10/2006 | Kobayashi et al. | 62/3.1 |
| 2008/0155993 | A1 * | 7/2008 | Kuehl | 62/3.6 |
| 2009/0260371 | A1 | 10/2009 | Kuehl et al. | |
| 2009/0293508 | A1 * | 12/2009 | Rafalovich et al. | 62/66 |
| 2010/0180608 | A1 * | 7/2010 | Shaha et al. | 62/66 |
| 2011/0100046 | A1 * | 5/2011 | Choi et al. | 62/320 |

FOREIGN PATENT DOCUMENTS

| | | | |
|---|---|---|---|
| EP | 0580952 | A1 | 2/1994 |
| EP | 0736738 | A2 | 10/1996 |
| GB | 2189016 | A | 10/1987 |

* cited by examiner

ICE MAKING, TRANSFERRING, STORING AND DISPENSING SYSTEM FOR A REFRIGERATOR

BACKGROUND OF THE INVENTION

1. Field of the Invention

The present invention pertains to the art of refrigerators and, more particularly, to the making of ice in a fresh food compartment of a refrigerator and transferring of the ice to an ice storage bin for subsequent, selective delivery to an ice dispenser.

2. Description of the Related Art

Automatic ice making systems for use in a home refrigerator are well known. Typically, home refrigerators will have both a fresh food compartment that is kept at a temperature above the freezing temperature of water, and a freezer compartment that is kept at a temperature below the freezing temperature of water. Since more energy must be used to maintain the temperature of the freezer compartment, the freezer compartment is often smaller than the fresh food compartment and space therein is relatively more valuable. Although the arrangement of such compartments varies from one refrigerator to another, the freezer compartment is usually either located above or below the fresh food compartment or the compartments are in a side-by-side arrangement. A wall, commonly called a mullion, usually separates the fresh food and freezer compartments and each compartment is provided with a separate door.

Refrigerators of these types are often provided with an ice making system. A typical ice making system includes an icemaker mounted within the freezer compartment of the refrigerator and an ice storage receptacle or bin supported beneath the icemaker for receiving the formed ice from the icemaker. The icemaker is commonly mounted within the freezer compartment adjacent the side or rear wall of the freezer compartment such that water and power can be conveniently supplied to the icemaker. The ice storage bin is supported by a shelf structure beneath the icemaker within the freezer compartment. Such icemakers usually have a metal mold that makes six to ten ice cubes at a time. A device is provided to harvest the ice so that the ice is transferred to the storage bin.

Often, the ice produced in conventional icemakers is dispensed through the freezer door via an ice transfer mechanism in the form of a chute that extends from the ice storage bin to a dispenser located in the freezer door. As such, the ice will start in the icemaker, drop from the icemaker into the storage bin located just beneath the icemaker, then be pushed through the storage bin, typically by a rotating auger, to the ice transfer mechanism in the form of a chute where the ice slides to the dispenser and then passes to a cup or other container for eventual use. A cold water dispenser is also usually provided adjacent the ice dispenser. More specifically, water is stored in a container in the fresh food compartment and travels, when needed, through a conduit to the dispenser located in the freezer door. This type of system is shown, for example, in U.S. Pat. No. 4,102,672.

While the above-described ice making arrangements are effective, the process by which they produce ice usually produces cloudy or "white" ice. Furthermore, the icemakers and storage bins take up valuable freezer space, which could be used for storing food. The present invention addresses the need in the art for an ice making system that produces better quality ice at a fast rate, while enhancing freezer compartment storage space through relocation of the icemaker. In addition, the invention further addressing potential problems associated with transferring ice from the relocated icemaker to both an ice storage bin and a dispenser located in one of the refrigerator doors.

SUMMARY OF THE INVENTION

A refrigerator incorporating the invention comprises a cabinet including a fresh food compartment, a freezer compartment, and a mullion separating the fresh food and freezer compartments. The mullion is provided with a passage interconnecting the fresh food and freezer compartments. A fresh food door selectively closes the fresh food compartment and a freezer door selectively closes the freezer compartment. In accordance with the invention, the refrigerator also comprises an ice making, transferring and storing system that includes an icemaker located in the fresh food compartment, with the icemaker being configured to produce ice in the fresh food compartment. The system further includes an ice storage bin for receiving the ice from the icemaker, with the ice storage bin being located in one of the fresh food and freezer compartments, and an ice transfer mechanism for delivering the ice from the fresh food compartment to the ice storage bin. The refrigerator further comprises an ice dispenser located in one of the fresh food and freezer doors and a second ice transfer mechanism for selectively delivering ice from the ice storage bin to the ice dispenser. Preferably, the fresh food compartment and the freezer compartment are located in a side-by-side arrangement.

In a first embodiment, an icemaker is provided in a fresh food compartment. An ice transfer mechanism is preferably in the form of a chute extending from an ice storage bin, also located in a fresh food compartment, through the mullion, to an ice dispenser provided in the freezer door. The ice storage bin has insulating walls for containing the ice, with the insulating walls including ethylene glycol. The bin may also have a drain for water created by melting ice.

In a second embodiment, an ice storage bin is located in a freezer compartment and an ice dispenser is in a fresh food compartment. A first ice transfer mechanism in the form of a chute delivers ice from an icemaker to the ice bin and a second ice transfer mechanism, also in the form of a chute, delivers ice from the ice storage bin to the ice dispenser through an opening in a wall between the fresh food and freezer compartments.

In a third embodiment, a fresh food compartment extends over a freezer compartment to form an extended storage area, an icemaker is located in the extended storage area, an ice storage bin is positioned in the freezer compartment, an ice dispenser is arranged in the freezer door, and a first ice transfer mechanism in the form of a chute delivers ice from the icemaker to the ice storage bin, while a second ice transfer mechanism is provided to deliver ice from the storage bin to the ice dispenser.

In a fourth embodiment, an icemaker is located in a fresh food compartment, an ice storage bin is located in a freezer compartment, and an ice dispenser is located in a freezer compartment below the ice storage bin.

In a fifth embodiment, an icemaker is located in a fresh food compartment, an ice storage bin is located in a freezer compartment, and an ice dispenser is provided in the freezer door below the ice storage bin. A first ice transfer mechanism lifts the ice from the icemaker to the storage bin, while a second ice transfer mechanism is used to deliver ice from the storage bin to the ice dispenser.

The invention is also directed to a method of making ice in a refrigerator which requires producing ice with an icemaker located in the fresh food compartment; delivering ice from the icemaker to an ice storage bin located in one of the fresh food compartment or the freezer compartment; storing the ice in one of the fresh food or freezer compartments; and selectively delivering ice from the ice storage bin to an ice dispenser located in one of the fresh food and freezer doors. In one embodiment, the ice storage bin is in the fresh food compartment such that ice is stored in the fresh food compartment, wherein storing the ice includes cooling the ice to keep the ice frozen. In accordance with other preferred embodiments, the ice storage bin is in the freezer compartment so that the ice is stored in the freezer compartment. The ice dispenser can be in either of the fresh food or freezer doors and the method further comprises delivering the ice from the ice storage bin to the dispenser through an ice transfer mechanism in the form of a chute.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
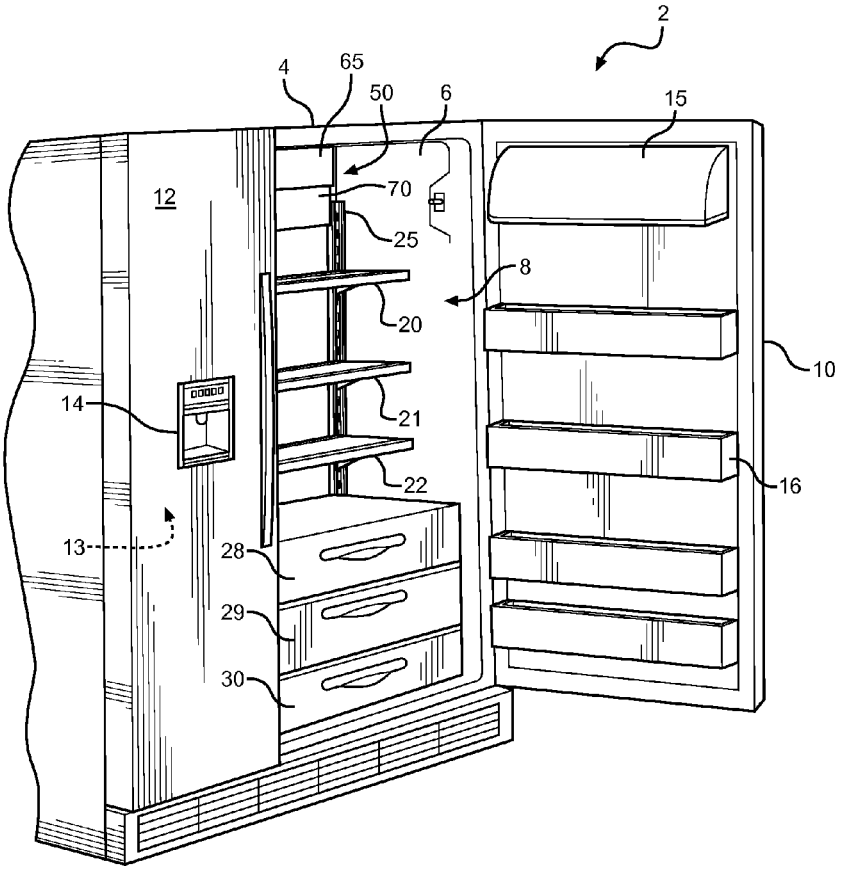
FIG. 1 is a perspective view of a refrigerator including an ice making, transferring and storing system according to a first preferred embodiment of the invention, with an icemaker and an ice storage bin located in a fresh food compartment of the refrigerator.

With initial reference to FIG. 1, a refrigerator 2 includes an outer shell or cabinet 4 within which is positioned a liner 6 that defines a fresh food compartment 8. In a manner known in the art, fresh food compartment 8 is accessed by the selective opening of a fresh food door 10. In a similar manner, a freezer door 12 can be opened to access a freezer compartment 13. In the embodiment shown, freezer door 12 includes a dispenser 14 that enables a consumer to retrieve ice and/or fresh water without accessing fresh food or freezer compartments 8 and 13. For the sake of completeness, door 10 of refrigerator 2 is shown to include a dairy compartment 15 and various vertically adjustable shelving units, one of which is indicated at 16.

In a manner known in the art, fresh food compartment 8 is provided with a plurality of vertically, height adjustable shelves 20-22 supported by a pair of shelf support rails, one of which is indicated at 25. At a lowermost portion of fresh food compartment 8 is illustrated various temperature controlled bins 28-30. At this point, it should be recognized that the above described refrigerator structure is shown for the sake of completeness. Instead, the present invention is particularly directed to an ice making, transferring, and storing system which is generally indicated at 50. Refrigerator 2 also includes a refrigeration system (not shown) for cooling fresh food and freezer compartments 8 and 13. As the refrigeration system is not an aspect of the invention, it will not be described in detail. However, a preferred arrangement also disclosed herein is U.S. patent application entitled "Multi-Evaporator Refrigerator" filed on even date herewith which is incorporated herein by reference. At this point, it should simply be noted that ice making, transferring and storing system 50 of this embodiment includes an icemaker 65 located above an ice storage bin 70.

Figure 2A:
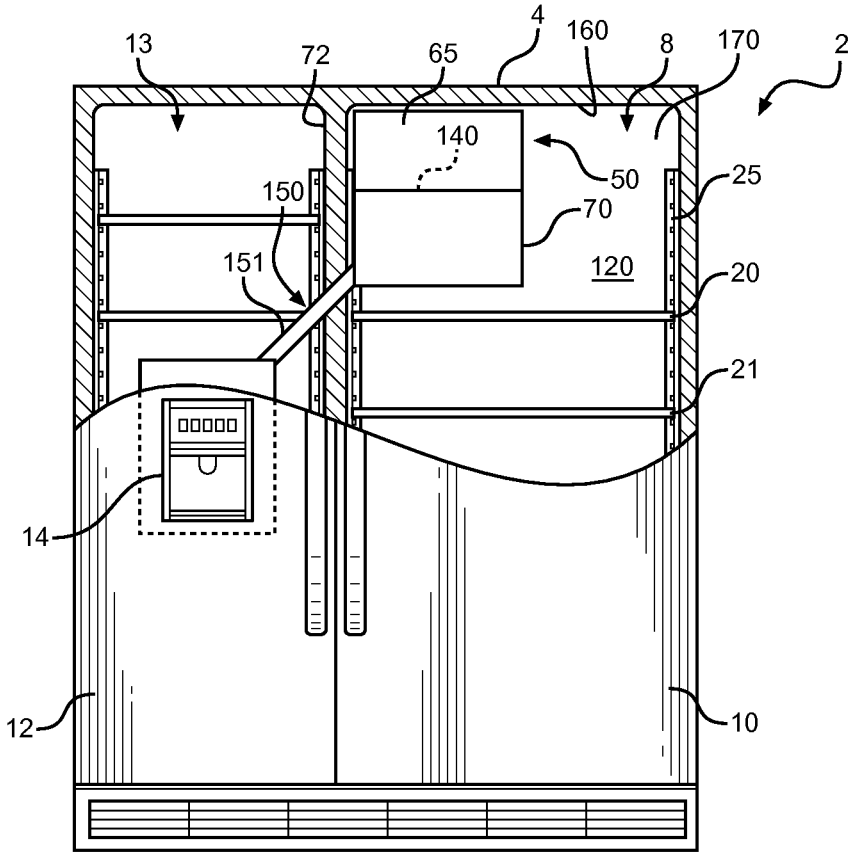
FIG. 2A is a front cut-away view of the refrigerator of FIG. 1.

The details of a refrigerator incorporating the ice making, transferring and storing system 50 according to the first embodiment of the invention shown in FIG. 2A will now be described wherein freezer door 12 and fresh food door 10 are shown in a closed configuration and a top portion of each door has been removed so as to more clearly show ice making, transferring and storing system 50. As illustrated in this figure, refrigerator 2 includes a mullion 72 which separates fresh food compartment 8 from freezer compartment 13. In this embodiment, ice making, transferring and storing system 50 includes icemaker 65 located in fresh food compartment 8, ice storage bin 70 also located within fresh food compartment 8, a first ice transfer mechanism which, in this embodiment, is simply constituted by a lower opening (not shown) in icemaker 65 leading to an upper opening 140 (also see FIG. 2B or 2C) and a second ice transfer mechanism 151 extending through mullion 72 and extending from fresh food compartment 8 into freezer compartment 13. At this point it should be recognized that, with icemaker 65 in fresh food compartment 8, more room is left in freezer compartment 13 for the storage of frozen food items. Another advantage is that icemaker 65 may be designed to produce clear ice. Clear icemakers are often designed to work in above freezing temperatures because they employ continuously flowing water. The details of how some exemplary clear icemakers and refrigeration systems function are found in U.S. Pat. Nos. 5,187,948 and 5,375,432, which are incorporated herein by reference.

Figure 2B:
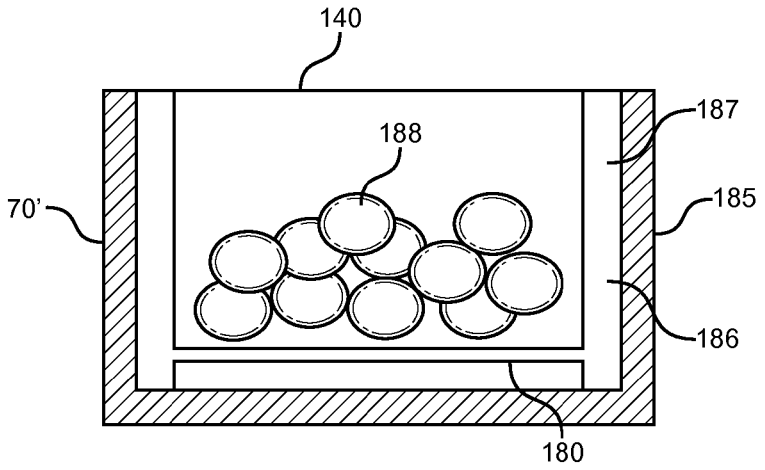
FIG. 2B is a cross-sectional view of an ice storage bin with ethylene glycol that is designed to store ice in a fresh food compartment.
Figure 2C:
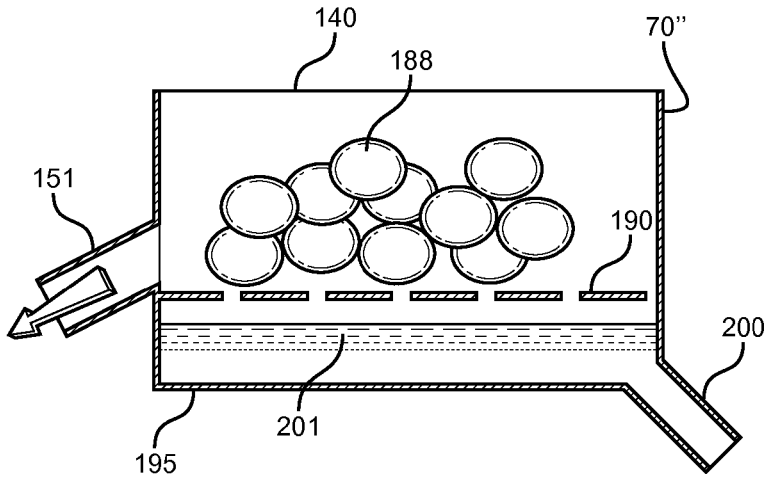
FIG. 2C is a cross-sectional view of an ice storage bin with a drain port that is designed to store ice in a fresh food compartment.

Regardless of the type of icemaker employed, icemaker 65 is preferably located toward the top of fresh food compartment 8 and is optionally mounted to top wall 160, back wall 170 or mullion 72. Being positioned toward the top of fresh food compartment 8 allows for ice produced by icemaker 65 to fall into ice storage bin 70 located directly below icemaker 65. Certainly, the location of ice storage bin 70 within fresh food compartment 8 presents certain concerns, particularly the potential of the produced ice melting because the temperature of fresh food compartment 8 is typically above freezing. To counter this concern, the ice storage bin is preferably provided either with a dedicated cooling mechanism or provisions are made to handle water caused by melting ice. For instance, a flow of refrigerant can be specifically directed to cool ice storage bin 70' such as through a conduit as represented at 180 in FIG. 2B and/or provisions can be made to handle water caused by melting ice as depicted in ice storage bin 70" in FIG. 2C. Specifically, as shown in FIG. 2B, ice storage bin 70' is provided with insulating walls 185 and an internal reservoir 186 in communication with conduit 180 so as to be filled with a circulating coolant 187 such as ethylene glycol. Conduit 180 of the refrigeration system is routed through reservoir 186 to maintain coolant 187 below the freezing temperature of water. Coolant 187 circulates through reservoir 186 and keeps ice 188 stored therein from melting. In the alternative embodiment shown in FIG. 2C, a bin 70" includes a grate 190 therein. Grate 190 supports ice 188 above a bottom wall 195. Ice 188 is dispensed from bin 70" through ice transfer device 151, i.e., the ice transfer device 151 shown in FIG. 2A extending from bin 70 through mullion 72 to dispenser 14. A separate passageway 200 is provided to allow water 201, developed from the melting of ice 188 that collects at the bottom of ice storage bin 70", to drain out of ice storage bin 70". In the alternative, water 201 could be pumped back to icemaker 65 for the making of additional ice. Preferably, ice storage bin 70" includes a mechanism, such as an auger (not shown), to move ice 188 from within ice storage bin 70" to dispenser 14 during an ice dispensing event.

Dispenser 14 is located in one of fresh food and freezer doors 10 and 12. In FIG. 2A, dispenser 14 is shown in freezer door 12, while in FIG. 3 dispenser 14' is shown in fresh food door 10. Dispenser 14 is configured to dispense both water and ice. That is, although not shown, a water reservoir is in communication with dispenser 14 for also selectively dispensing refrigerated water from the water reservoir. A water inlet pump (not shown) can be provided to transport the water. The details of a typical dispenser are known in the art and found, for example, in U.S. Pat. No. 4,102,672, specifically incorporated herein by reference.

Figure 3:
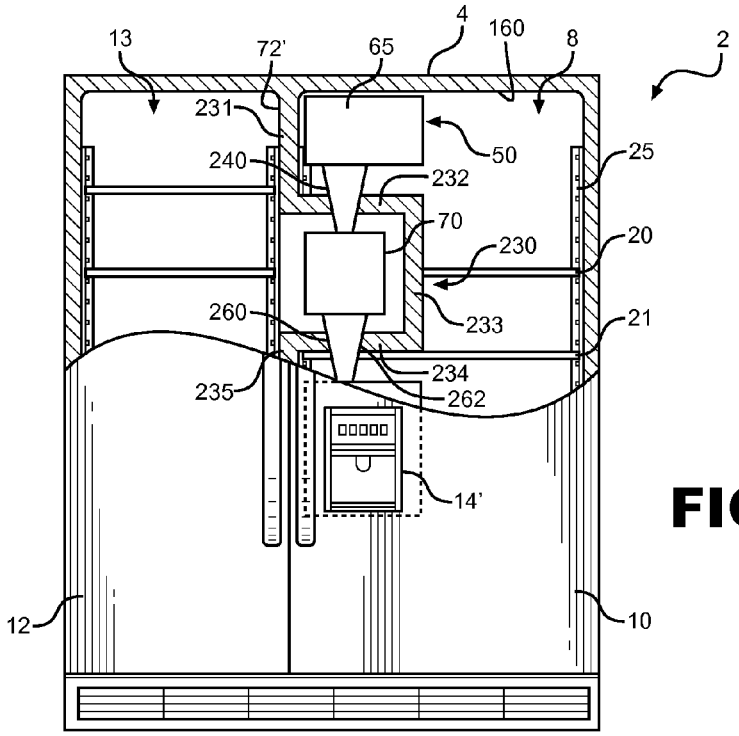
FIG. 3 is a front cut-away view of a refrigerator including an ice making, transferring and storing system according to a second embodiment of the invention, with an icemaker in a fresh food compartment and an ice storage bin in an extended portion of the freezer.
Figure 4:
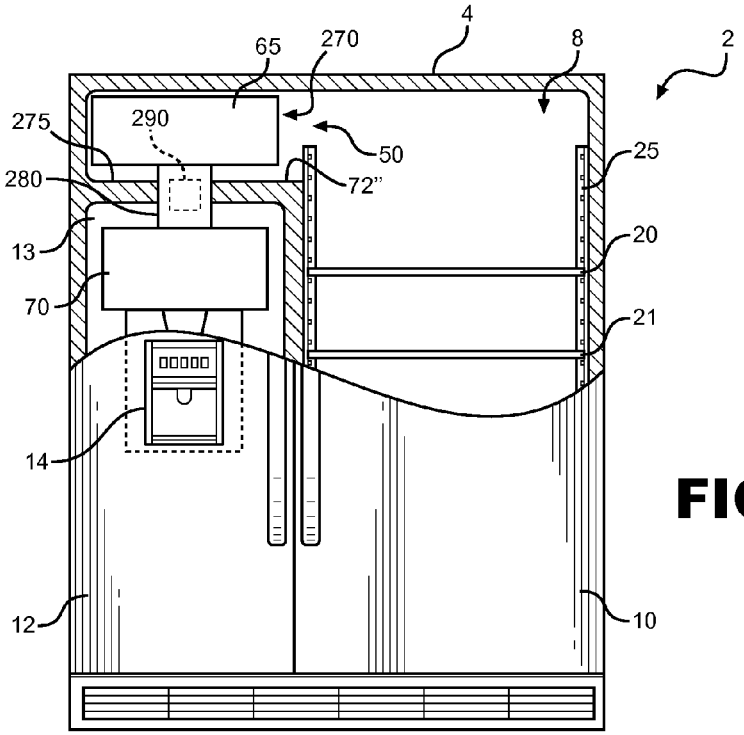
FIG. 4 is a front cut-away view of a refrigerator including an ice making, transferring and storing system according to a third embodiment of the invention, with an icemaker in an extended portion of a fresh food compartment and an ice storage bin in the freezer compartment.

Turning now to FIGS. 3 and 4, there are shown second and third embodiments of the invention. In each case, mullions 72', 72" between freezer compartment 13 and fresh food compartment 8 are not straight, resulting in at least a fresh food compartment that has a varying width. The manner of establishing a refrigerator with varying width compartments may be found in U.S. Pat. Nos. 6,019,447 or 7,726,756 which are incorporated herein by reference. In the embodiment shown, fresh food door 10 and freezer door 12 are preferably rectangular. However, doors 10, 12 can optionally be shaped to follow the contour of fresh food compartment 8 and freezer compartment 13 formed in part by mullions 72' and 72".

With specific reference to FIG. 3, there is shown an arrangement wherein freezer compartment 13 has a portion 230 that extends behind fresh food door 10. More specifically, mullion 72' has a top section 231 extending vertically from top wall 160 of cabinet 4, a first wall 232 extending horizontally from top section 231, a middle section 233 extending vertically down from first wall 232, and a second wall 234 extending horizontally and generally parallel to first wall 232 to collectively form the periphery of portion 230. A lower section 235 of mullion 72' extends vertically to the bottom of cabinet 4 from second wall 234. Icemaker 65 is located in fresh food compartment 8 above first wall 232. Ice storage bin 70 is located in freezer compartment 13 below first wall 232 and above second wall 234. A dispenser 14' is located in fresh food compartment door 10 below second wall 234. A first ice transfer mechanism in the form of a chute 240 delivers ice from icemaker 65 to ice storage bin 70 through an opening (not labeled) in first wall 232, and a second ice transfer mechanism or chute 262 delivers ice from ice storage bin 70 to dispenser 14' through an opening (not labeled) in second wall 234. Since ice storage bin 70 is located in freezer compartment 13, no provision is needed to provide for draining water formed by melting ice.

With specific reference to FIG. 4, there is shown an arrangement wherein fresh food compartment 8 extends over freezer compartment 13 to form an extended storage area 270, with icemaker 65 being located in extended storage area 270. Mullion 72" includes a horizontal section 275 forming a bottom wall of extended storage area 270. Ice storage bin 70 is located in freezer compartment 13 below horizontal section 275. An ice transfer mechanism in the form of a chute 280 delivers ice from icemaker 65 through horizontal section 275 to ice storage bin 70. A transfer door 290 is mounted in ice transfer mechanism, which takes the form of a chute 280. Transfer door 290 selectively allows ice to pass there through. Transfer door 290 is preferably constituted by a trap door or flap which is spring biased closed, but could be activated with a motor (not shown), in order to enable ice to be transferred from ice storage bin 70 to dispenser 14.

Figure 5:
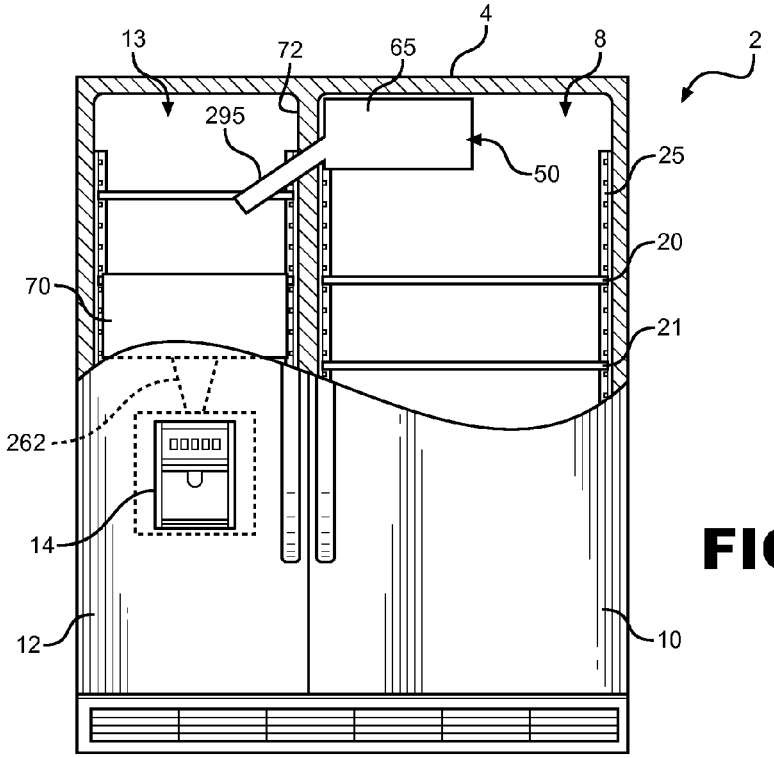
FIG. 5 is a front cut-away view of a refrigerator including an ice making, transferring and storing system according to a fourth embodiment of the invention, with an icemaker in a fresh food compartment and an ice storage bin in a freezer compartment.
Figure 6:
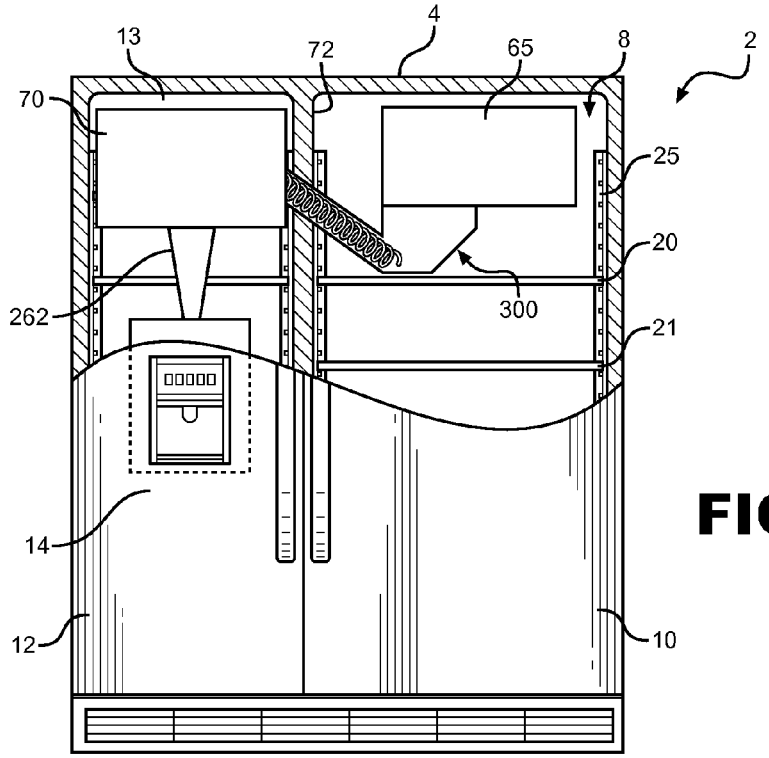
FIG. 6 is a front cut-away view of a refrigerator including an ice making, transferring and storing system according to a fifth embodiment of the invention, with an icemaker in a fresh food compartment and an ice storage bin located at substantially the same level as the icemaker in a freezer compartment.

FIGS. 5 and 6 show fourth and fifth embodiments of the invention. In each case, icemaker 65 is in fresh food compartment 8 and dispenser 14 is in freezer door 12. However, the vertical location of ice storage bin 70 varies. More specifically, in FIG. 5, ice storage bin 70 is located below the height of icemaker 65, thus allowing for the use of an ice transfer mechanism in the form of a chute 295 to transport ice from icemaker 65 to ice storage bin 70. In FIG. 6, ice storage bin 70 is located near the top of freezer compartment 13 and an ice transfer mechanism in the form of an ice conveyer unit 300 (e.g., a transfer bin and auger combination in the particular embodiment shown) is used to transport ice from below icemaker 65 up to ice storage bin 70.

Although described with reference to preferred embodiments of the invention, it should be readily understood that various changes and/or modifications could be made to the invention without departing from the spirit thereof. For instance, while ice chutes are shown in various preferred embodiments, in most cases ice could simply fall due to gravity from the icemaker into an ice storage bin or from the ice storage bin to a dispenser. Also, the transfer door may be controlled by the icemaker so that the door automatically opens during a harvest cycle of the icemaker. Furthermore, although particularly shown and described with reference to various side-by-side refrigerator model embodiments, the invention could also be applied to other model types, including top mount and French door-style models. In general, the invention is only intended to be limited by the scope of the following claims.

What is claimed is:

1. A refrigerator comprising:

a cabinet adapted to be cooled by a refrigeration system, said cabinet including a fresh food compartment, a freezer compartment, and a mullion extending vertically and separating the fresh food compartment and the freezer compartment to be in a side by side configuration, with said mullion being provided with a passage interconnecting the fresh food and freezer compartments;

a fresh food door for selectively closing the fresh food compartment;

a freezer door for selectively closing the freezer compartment; and an ice making, transferring and storing system including:

an icemaker located in a portion of the fresh food compartment, said icemaker being configured to produce ice in the fresh food compartment;

an ice storage bin for receiving the ice from the icemaker, said ice storage bin being located in a portion of the freezer compartment;

a first ice transfer mechanism extending through the mullion for delivering the ice from the icemaker in the fresh food compartment to the ice storage bin in the freezer compartment through the passage;

an ice dispenser located in the freezer door; and a second ice transfer mechanism for selectively delivering ice from the ice storage bin to the ice dispenser, wherein the mullion extends between portions of the ice making, transferring and storage system with the portion of the fresh food compartment containing the icemaker extending across the portion of the freezer compartment containing the ice storage bin.

2. A refrigerator comprising:

a cabinet adapted to be cooled by a refrigeration system, said cabinet including a fresh food compartment, a freezer compartment, and a mullion extending vertically and separating the fresh food compartment and the freezer compartment to be in a side by side configuration, with said mullion being provided with a passage interconnecting the fresh food and freezer compartments;

a fresh food door for selectively closing the fresh food compartment;

a freezer door for selectively closing the freezer compartment; and an ice making, transferring and storing system including:

an icemaker located in a portion of the fresh food compartment, said icemaker being configured to produce ice in the fresh food compartment;

an ice storage bin for receiving the ice from the icemaker, said ice storage bin being located in a portion of the freezer compartment;

a first ice transfer mechanism extending through the mullion for delivering the ice from the icemaker in the fresh food compartment to the ice storage bin in the freezer compartment through the passage;

an ice dispenser located in the fresh food door, wherein the ice dispenser is located below the portion of the freezer compartment containing the ice storage bin; and a second ice transfer mechanism extending through the mullion for selectively delivering ice from the ice storage bin to the ice dispenser, wherein the mullion extends between portions of the ice making, transferring and storage system with the portion of the fresh food compartment containing the icemaker being above the portion of the freezer compartment containing the ice storage bin.

3. A method of making ice in a refrigerator having a cabinet adapted to be cooled by a refrigeration system and including a fresh food compartment, a freezer compartment, and a mullion extending vertically and separating the fresh food compartment and the freezer compartment so that the fresh food compartment and freezer compartment are in a side by side configuration, with said mullion being provided with a passage interconnecting the fresh food and freezer compartments, a fresh food door for selectively closing the fresh food compartment, and a freezer door for selectively closing the freezer compartment, said method comprising:

producing ice with an icemaker located in the fresh food compartment;

delivering ice from the icemaker to an ice storage bin located in the freezer compartment, wherein delivering ice from the icemaker to the ice storage bin constitutes lifting the ice from the icemaker up to the ice storage bin, and wherein lifting the ice from the icemaker up to the ice storage bin includes lifting the ice from a location outside the ice storage bin to a location inside the ice storage bin;

at least temporarily, storing the ice in the ice storage bin; and selectively delivering ice from the ice storage bin to an ice dispenser located in one of the fresh food and freezer doors.

4. The method of claim 3, further comprising:

delivering ice from the icemaker to the ice storage bin through the mullion.

5. The refrigerator of claim 1 wherein the mullion conforms around portions of the ice making, transferring and storing system and the portion of the fresh food compartment containing the icemaker extends over the portion of the freezer compartment containing the ice storage bin.

6. The refrigerator of claim 2 wherein the mullion conforms around portions of the ice making, transferring and storing system.

7. The method of claim 3, wherein lifting the ice from the icemaker up to the ice storage bin includes lifting the ice from the icemaker up to the ice storage bin with an ice transfer mechanism located at least partially outside the ice storage bin.

8. The method of claim 7, wherein lifting the ice from the icemaker up to the ice storage bin with the ice transfer mechanism includes lifting the ice from the icemaker up to the ice storage bin with an auger.

9. The method of claim 8, wherein the auger extends from a transfer bin located below the icemaker, through the mullion and to the ice storage bin, and wherein lifting the ice from the icemaker up to the ice storage bin includes lifting the ice from the transfer bin up through the mullion and to the ice storage bin with the auger.

10. The method of claim 3, wherein a transfer bin is located below the icemaker, and wherein lifting the ice from the icemaker up to the ice storage bin includes lifting the ice from the ice transfer bin up to the ice storage bin.

* * * * *